US012569047B2

(12) United States Patent
Chiang et al.

(10) Patent No.: US 12,569,047 B2
(45) Date of Patent: Mar. 10, 2026

(54) HEALTHCARE COMB

(71) Applicant: SHANGHAI YINGSHAN ENVIRONMENTAL PROTECTION TECHNOLOGY CO., LTD, Shanghai (CN)

(72) Inventors: Ying-Hsuan Chiang, Shanghai (CN); Ming-Hui Chiang, Shanghai (CN)

(73) Assignee: SHANGHAI YINGSHAN ENVIRONMENTAL PROTECTION TECHNOLOGY CO., LTD, Shanghai (CN)

( * ) Notice: Subject to any disclaimer, the term of this patent is extended or adjusted under 35 U.S.C. 154(b) by 482 days.

(21) Appl. No.: 18/004,282

(22) PCT Filed: Dec. 27, 2021

(86) PCT No.: PCT/CN2021/141506
§ 371 (c)(1),
(2) Date: Jan. 4, 2023

(87) PCT Pub. No.: WO2023/273248
PCT Pub. Date: Jan. 5, 2023

(65) Prior Publication Data

US 2023/0255337 A1 Aug. 17, 2023

(30) Foreign Application Priority Data

Jul. 1, 2021 (CN) ..... 202110743849.8

(51) Int. Cl.
*A45D 24/30* (2006.01)
*A45D 24/04* (2006.01)

(52) U.S. Cl.
CPC ..... *A45D 24/30* (2013.01); *A45D 24/04* (2013.01)

(58) Field of Classification Search
CPC ..... A45D 24/30; A45D 24/04; A45D 24/40; A45D 24/42; A45D 24/44; A45D 24/08; A45D 24/10; A45D 24/46
See application file for complete search history.

(56) References Cited

U.S. PATENT DOCUMENTS 2,827,895 A * 3/1958 Clohecy ..... A61H 7/003 132/125
2014/0026822 A1* 1/2014 Harris, II ..... A01K 13/002 119/625
2018/0295978 A1* 10/2018 Kim ..... A46D 1/0261

FOREIGN PATENT DOCUMENTS

CN 1375250 A 10/2002
CN 201709657 U 1/2011
(Continued)

OTHER PUBLICATIONS

Clarivate Analytics copyrighted translation of CN213554919U; publication date Jun. 29, 2021 (Year: 2021).*
(Continued)

*Primary Examiner* — Tatiana L Nobrega
*Assistant Examiner* — Sarah Woodhouse
(74) *Attorney, Agent, or Firm* — Bookoff McAndrews, PLLC

(57) ABSTRACT

An interesting healthcare comb having a significant effect for cleaning dandruff, grease, and impurities may include a comb handle and a comb base that may be mounted on one side of the comb base. A cavity may be formed inside the comb base, a seat plate may be arranged at the lower end of the comb base, and a top plate may be arranged at a top end of the comb base. A plurality of comb teeth may be arranged at one end of the seat plate away from the top plate, and provided with through holes along axial directions thereof. Openings corresponding to the through holes may be formed in the seat plate. A pressing plate may be arranged in the
(Continued)

cavity, and ejector pins may be arranged on the pressing plate and penetrate through the openings to extend into the through holes of the comb teeth.

6 Claims, 5 Drawing Sheets

(56) References Cited

FOREIGN PATENT DOCUMENTS

| | | | |
|---|---|---|---|
| CN | 104411206 | A | 3/2015 |
| CN | 204393641 | U | 6/2015 |
| CN | 205658534 | U | 10/2016 |
| CN | 106419054 | A | 2/2017 |
| CN | 206880318 | U | 1/2018 |
| CN | 207391623 | U | 5/2018 |
| CN | 108652181 | A | 10/2018 |
| CN | 212878135 | U | 4/2021 |
| CN | 213554919 | U | 6/2021 |
| CN | 113273789 | A | 8/2021 |
| CN | 215685429 | U | 2/2022 |
| IN | 201208452 | Y | 3/2009 |
| JP | 2004313588 | A | 11/2004 |
| JP | 2013111218 | A | 6/2013 |
| KR | 2020100012233 | U | 12/2010 |
| KR | 20190072983 | A | 6/2019 |

OTHER PUBLICATIONS

Clarivate Analytics copyrighted translation of CN106037227A; publication date Oct. 26, 2016 (Year: 2016).*

Clarivate Analytics copyrighted translation of KR200415385Y1; publication date May 2, 2006 (Year: 2006).*

Clarivate Analytics copyrighted translation of WO2020/234297; international filing date of May 19, 2020 (Year: 2020).*

International Search in PCT/CN2021/141506, dated Mar. 9, 2022 (4 pages).

* cited by examiner

HEALTHCARE COMB

CROSS-REFERENCE TO RELATED APPLICATION

This application is a national stage application of international application no. PCT/CN2021/141506, filed Dec. 27, 2021, which claims priority to Chinese Patent Application No. 202110743849.8, filed Jul. 1, 2021, the disclosure of which is incorporated by reference herein in its entirety as part of the present application.

TECHNICAL FIELD

The present disclosure relates to the technical field of daily necessities, and in particular relates to an interesting healthcare comb.

BACKGROUND

Comb, as an essential daily necessity, plays a very important role in daily life, which is not only used as an important tool for dressing and makeup, but also has an apparent effect in hair protection and brain healthcare.

There are many blood vessels, nerves, sebaceous glands, sweat glands and the like distributed on the scalp of human. Combing not only can remove dandruff and grease, but also can stimulate nerve endings when the comb teeth gently rake back and forth across the head, thus regulating the nerves of the head and relaxing the tense state of the head through the cerebral cortex. The blood circulation is promoted, and hair follicles, sebaceous glands and sweat glands are fully nourished.

The existing comb is simple in structure, not effective enough in removing dandruff and grease, and not interesting in design. Therefore, it is difficult for users to develop a good habit of carrying the comb around.

SUMMARY

An objective of the present disclosure is to provide an interesting healthcare comb to solve the technical problem above.

To achieve the objective above, the interesting healthcare comb of the present disclosure comprises a comb handle and a comb base. A cavity is formed inside the comb base, the comb handle is mounted on one side of the comb base, a seat plate is arranged at the lower end of the comb base, and a top plate is arranged at the top end of the comb base. A plurality of comb teeth are arranged at one end, away from the top plate, of the seat plate, the comb teeth are provided with through holes along axial directions thereof, and openings corresponding to the through holes are formed in the seat plate. A pressing plate is arranged in the cavity of the comb base, ejector pins are arranged on the pressing plate and penetrate through the openings on the seat plate to extend into the through holes of the comb teeth. First springs are mounted between the pressing plate and the seat plate, a first limiting hole is formed in the upper end of the top plate, and a ball is arranged between the first limiting hole and the pressing plate. The first springs are configured to limit the ball in the first limit hole by compressing the pressing plate.

As one of the embodiments of the comb base in the present disclosure, the seat plate is clamped to the comb base, and the top plate and the comb base are of an integrated structure.

As another embodiment of the comb base in the present disclosure, the top plate is clamped to the comb base, and the seat plate and the comb base are of an integrated structure.

Further, the pressing plate is provided with a limiting groove corresponding to the ball.

Further, the lower end of the seat plate is provided with a comb cover.

Further, the outer surface of the ball is textured to increase friction. The ball can be used as a button for driving the ejector pins, and can also be used for playing to improve the fun. In addition, a plurality of balls may also be provided, and the plurality of balls can be used for massage.

As a first embodiment of the comb cover in the present disclosure, one end, away from the comb base, of the comb cover is an outer convex surface, a first partition plate seamlessly attached to the outer convex surface is arranged in the comb cover, and an accommodating chamber is formed between the first partition plate and the outer convex surface. One end, close to the comb base, of the first partition plate is a convex surface, and one end, far away from the comb base, of the first partition plate is provided with a driving device for pushing the first partition plate to move towards an opening direction of the comb cover.

As a second embodiment of the comb cover in the present disclosure, one end, away from the comb base, of the comb cover is provided with a protruding structure which is a second partition plate, and an accommodating chamber is formed between the second partition plate and the comb cover. The bottom of the second partition plate is provided with a second limiting hole, and a limiting ball is arranged on the second limiting hole. One end, away from the comb base, of the second partition plate is provided with a driving device for pushing the limiting ball to move towards an opening direction of the comb cover.

As a first embodiment of the driving device, the driving device comprises a push rod. The push rod is connected to the first partition plate or the limiting ball. A mounting seat is arranged at the bottom of the comb cover. The push rod penetrates through the mounting seat and the bottom of the comb cover. A second spring sleeved outside the push rod is arranged in the mounting seat. A pressing sheet connected to the push rod is arranged between the second spring and the bottom of the comb cover. A button is mounted on one end, extending out of the bottom of the comb cover, of the push rod.

As a second embodiment of the driving device, the driving device comprises a screw on which a limiting groove is arranged. The first partition plate or the limiting ball is sleeved with the limiting groove by a connector. The bottom of the comb cover is provided with a nut. The screw is threaded to the nut and penetrates through the bottom of the comb cover. A rotary cap is connected to one end, penetrating through the bottom of the comb cover, of the screw.

Further, the bottom of the accommodating chamber is provided with a dumping port.

It is worth noting that the button or the rotary cap may be mounted at the bottom of the comb cover in an embedded manner, thus the protruding part is reduced, and the comb is more visually pleasant.

As a third embodiment of the comb cover in the present disclosure, one side of the comb cover is provided with a branch tube communicating with the inside of the comb cover, two check valves in an outward direction are mounted on the branch tube, the branch tube between the check valves is provided with an adapter, and the adapter communicates with a suction ball by a hose.

The present disclosure has the beneficial effects that:

As the through holes are formed in the comb teeth of the interesting healthcare comb, impurities such as dandruff, grease and the like can be removed by combing, and the effect is more obvious than that of the nonporous structure. The ejector pins can remove impurities in the through holes. The button that drives the ejector pins to move is designed as a ball, and the ball can be used for playing, making the comb more interesting and facilitating users to develop a good habit for carrying the comb around. Furthermore, the comb has a massage function. The comb cover of a special structure is designed to accommodate the cleaned impurities, and the impurities can be cleaned at any time more conveniently.

Figure 1:
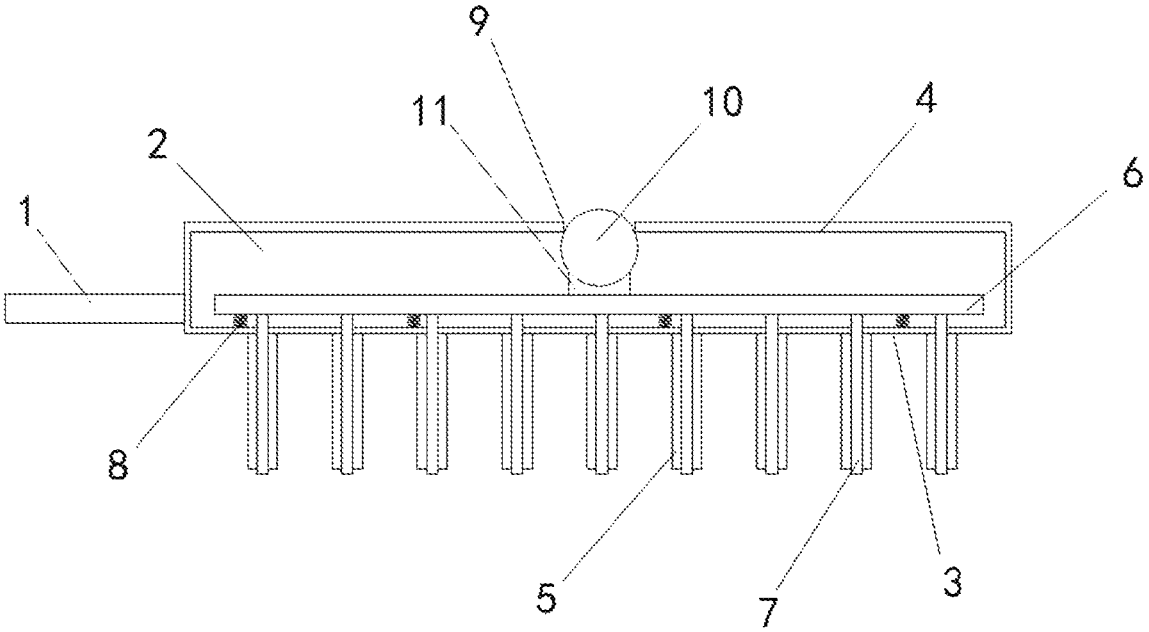
FIG. 1 is a structure diagram of a healthcare comb.

In the drawings: 1—comb handle; 2—comb base; 3—seat plate; 4—top plate; 5—comb teeth; 6—pressing plate; 7—ejector pin; 8—first spring; 9—first limiting hole; 10—ball; 11—limiting groove; 12—comb cover; 13—first partition plate; 14—second partition plate; 15—second limiting hole; 16—limiting ball; 17—push rod; 18—mounting seat; 19—second spring; 20—pressing sheet; 21—button; 22—screw; 23—limiting groove; 24—connector; 25—nut; 26—rotary cap; 27—dumping port; 28—branch tube; 29—check valve; 30—adapter; 31—hose; 32—suction ball.

DETAILED DESCRIPTION OF THE EMBODIMENTS

In order to make objectives, technical solutions, and advantages of the present disclosure clearer, the technical solutions in the present disclosure are described clearly and completely in the following with reference to accompanying drawings in the embodiments of the present invention. Apparently, the described embodiments are only part rather than all of the embodiments of the present disclosure. On the basis of the embodiments of the present invention, all other embodiments acquired by those of ordinary skill in the art without making inventive efforts fall within the scope of protection of the present disclosure. Unless otherwise mentioned, all technical and scientific terms used herein have the same meaning as commonly understood by one of ordinary skill in the art to which the present disclosure belong. As used herein, the words "comprise", "include", and the like are intended to mean that the elements or objects before the word cover the elements or objects or equivalents listed after the word, without excluding other elements or objects.

Embodiment

For the problem in the prior art, the embodiment of the present disclosure provides an interesting healthcare comb. The interesting healthcare comb comprises a comb handle 1 and a comb base 2. A cavity is formed inside the comb base 2, the comb handle 1 is mounted on one side of the comb base, a seat plate 3 is arranged at the lower end of the comb base 2, and a top plate 4 is arranged at the top end of the comb base 2. A plurality of comb teeth 5 are arranged at one end, away from the top plate 4, of the seat plate 3, the comb teeth 5 are provided with through holes along axial directions thereof, and openings corresponding to the through holes are formed in the seat plate 3. A pressing plate 6 is arranged in the cavity of the comb base 2, ejector pins 7 are arranged on the pressing plate 6 and penetrate through the openings on the seat plate 3 to extend into the through holes of the comb teeth 5. First springs 8 are mounted between the pressing plate 6 and the seat plate 3, a first limiting hole 9 is formed in the upper end of the top plate 4 (that is, the first limiting hole 9 is formed in the top plate 4), and a ball 10 is arranged between the first limiting hole 9 and the pressing plate 6. The first springs 8 are configured to limit the ball 10 in the first limit hole 9 by compressing the pressing plate 6.

Figure 2:
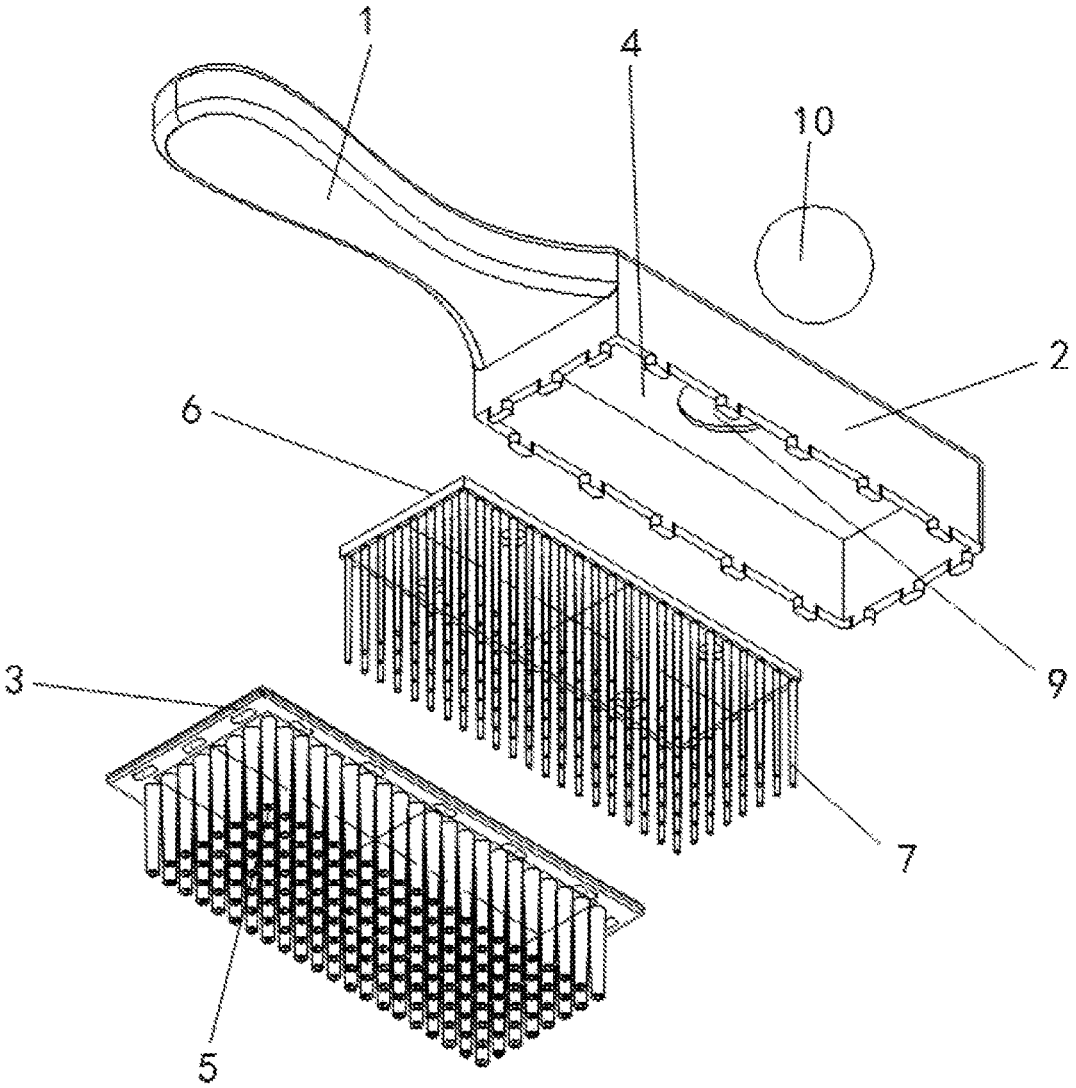
FIG. 2 a schematic diagram of a mounting structure of a healthcare comb of a first comb base structure.

As shown in FIG. 2, as one of the embodiments of the comb base 2 in the present disclosure, the seat plate 3 is clamped to the comb base 2, and the top plate 4 and the comb base 2 are of an integrated structure.

Figure 3:
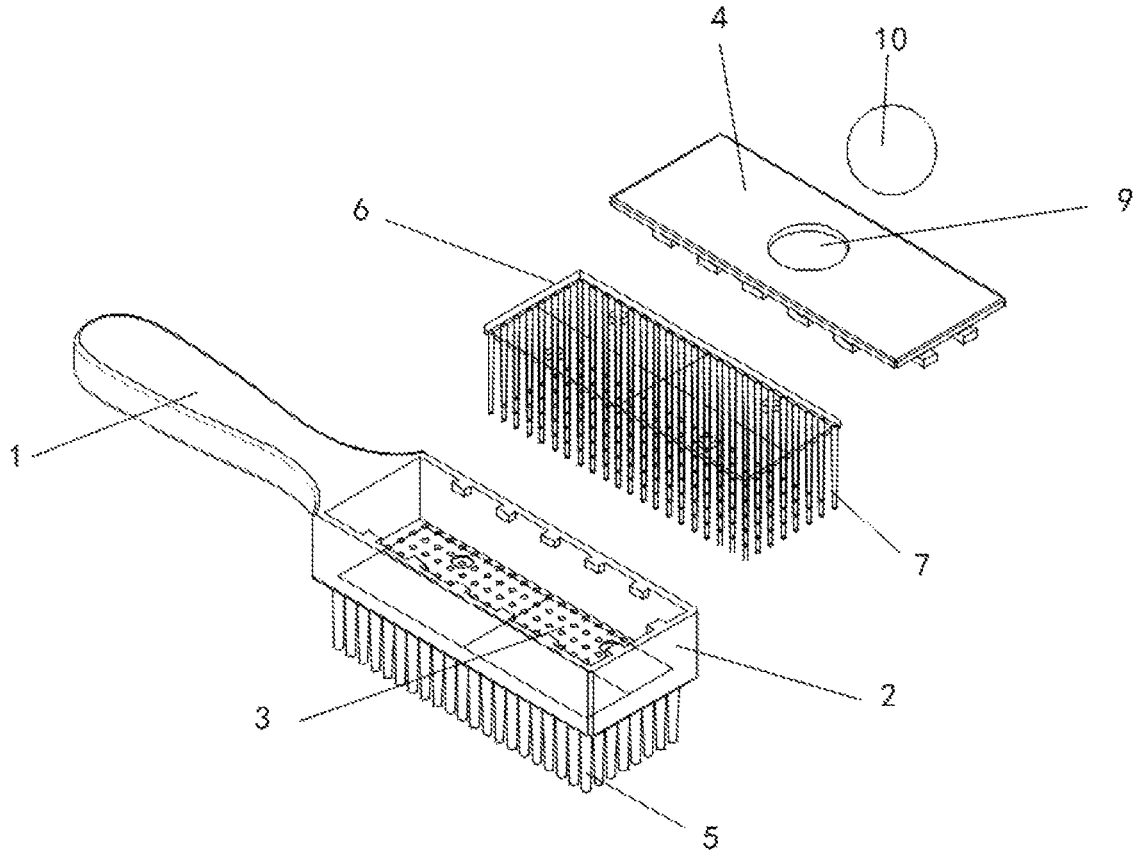
FIG. 3 is a schematic diagram of a mounting structure of a healthcare comb of a second comb base structure.

As shown in FIG. 3, as another embodiment of the comb base 2 in the present disclosure, the top plate 4 is clamped to the comb base 2, and the seat plate 3 and the comb base 2 are of an integrated structure.

The pressing plate 6 is provided with a limiting groove 11 corresponding to the ball.

The lower end of the seat plate 3 is provided with a comb cover 12.

The outer surface of the ball 10 is textured to increase friction. The ball 10 can be used as a button for driving the ejector pins 7, and can also be used for playing to improve the fun. In addition, a plurality of balls 10 may also he provided, and the plurality of balls can be used for massage.

As a first embodiment of the comb cover 12 in the present disclosure, one end, away from the comb base 2, of the comb cover 12 is an outer convex surface, a first partition plate 13 seamlessly attached to the outer convex surface is arranged in the comb cover 12, that is, an outer ring of the first partition plate 13 is attached to an inner wall of the outer convex surface, and an accommodating chamber is formed between the first partition plate 13 and the outer convex surface. One end, close to the comb base 2, of the first partition plate 13 is a convex surface, and one end, far away from the comb base 2, of the first partition plate 13 is provided with a driving device for pushing the first partition plate 13 to move towards an opening direction of the comb cover 12. The outer convex surface above is the bottom end surface of the comb cover 12 and is arranged opposite to an opening of the comb cover 12.

As a second embodiment of the comb cover 12 in the present disclosure, one end, away from the comb base 2, of the comb cover 12 is provided with a protruding structure which is a second partition plate 14, and an accommodating chamber is formed between the second partition plate 14 and the comb cover 12. The bottom of the second partition plate 14 is provided with a second limiting hole 15, and a limiting ball 16 is arranged on the second limiting bole 15. One end, away from the comb base 2, of the second partition plate 14 is provided with a driving device for driving the limiting ball 16 to move towards an opening direction of the comb cover 12.

Figure 4:
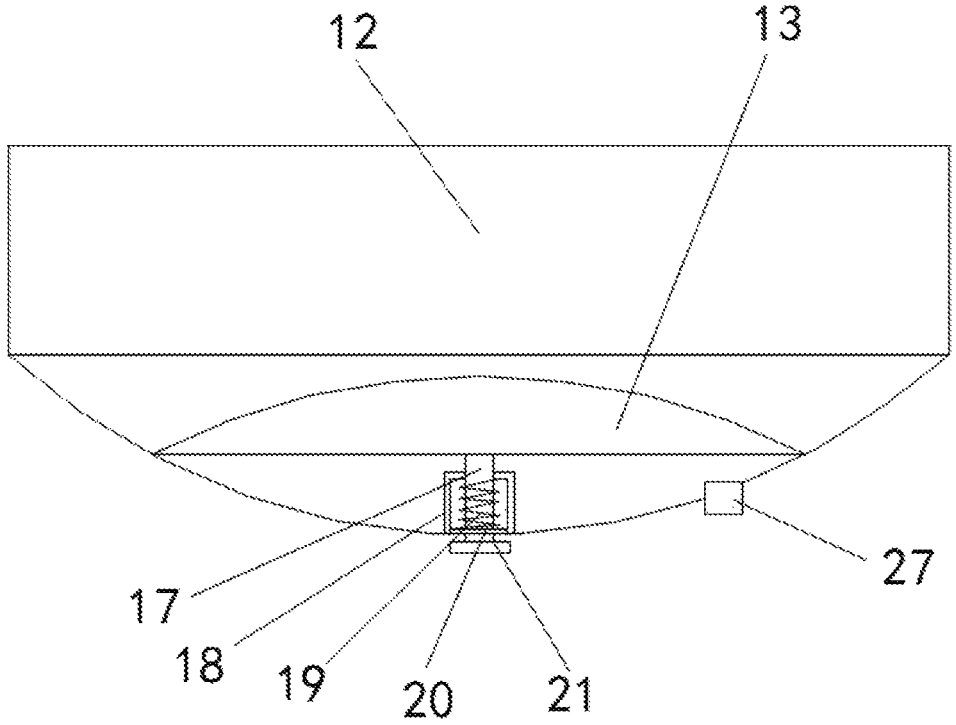
FIG. 4 is a diagram of a structure a first comb cover using a first driving mode.
Figure 5:
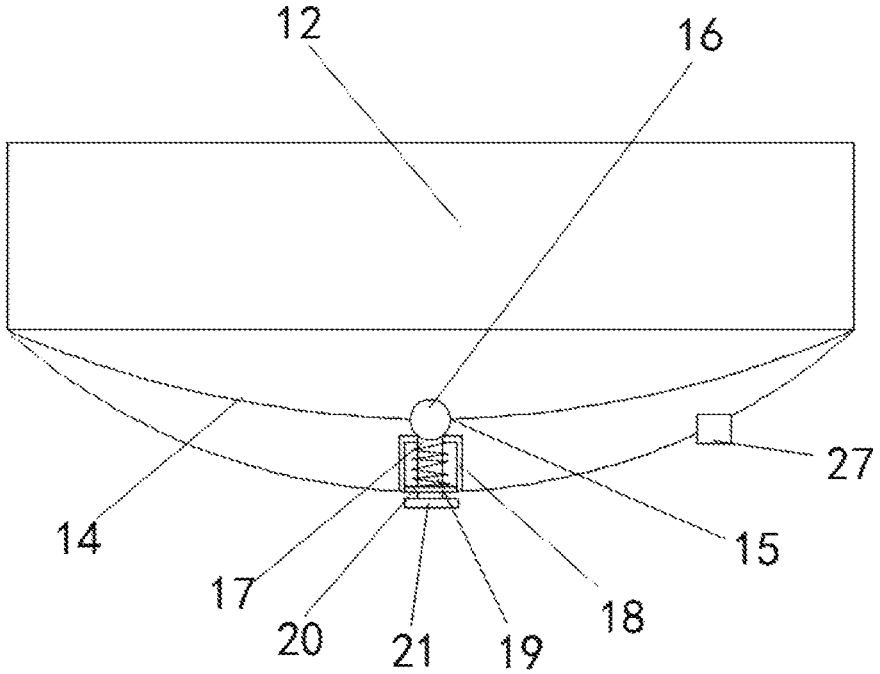
FIG. 5 is a diagram of a structure of a second comb cover using a first driving mode.

As shown in FIG. 4 or FIG. 5, as a first embodiment of the driving device, the driving device comprises a push rod 17.

The push rod 17 is connected to the first partition plate 13 or the limiting ball 16. A mounting seat 18 is arranged at the bottom of the comb cover 12. The push rod 17 penetrates through the mounting seat 18 and the bottom of the comb cover 12. A second spring 19 sleeved outside the push rod 17 is arranged in the mounting seat 18. A pressing sheet 20 connected to the push rod is arranged between the second spring 19 and the bottom of the comb cover 12. A button 21 is mounted on one end, extending out of the bottom of the comb cover 12, of the push rod 17.

Figure 6:
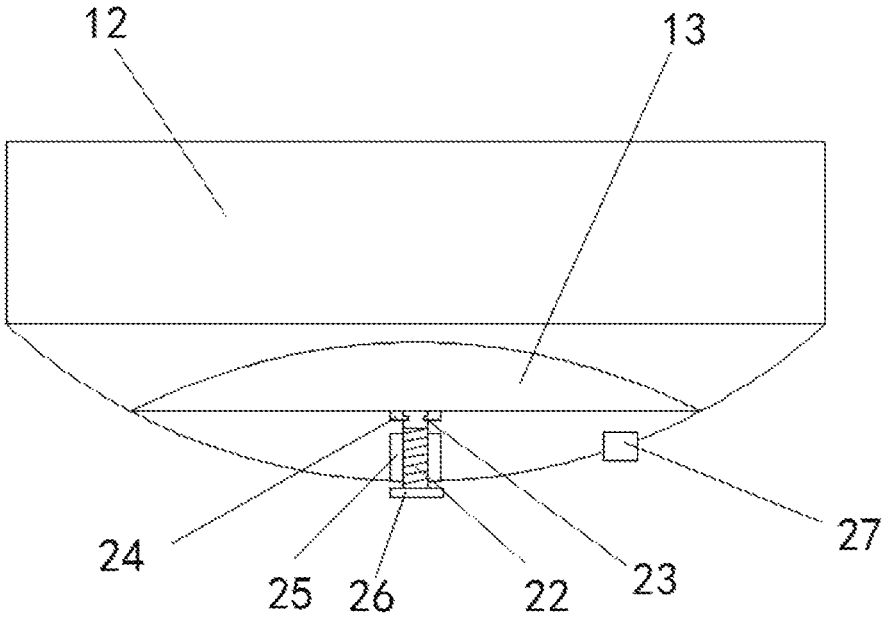
FIG. 6 is a diagram of a structure of a first comb cover using a second driving mode.
Figure 7:
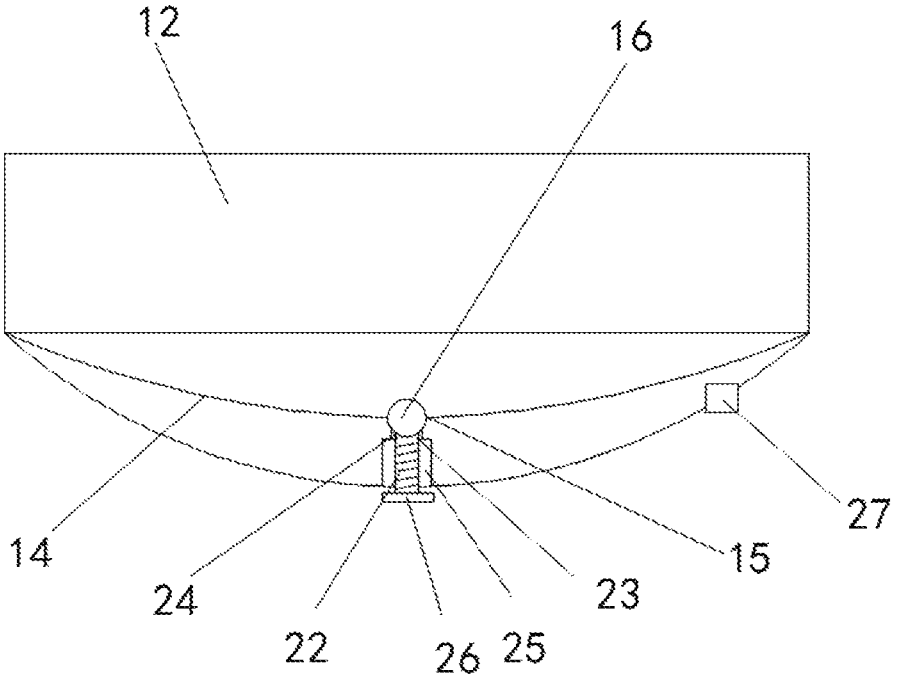
FIG. 7 is a diagram of a structure of a second comb coven using a second driving mode.

As shown in FIG. 6 or FIG. 7, as a second embodiment of the driving device, the driving device comprises a screw 22 in which a limiting groove 23 is formed. The first partition plate 13 or the limiting ball 16 is sleeved with the limiting groove 23 by a connector 24. The bottom of the comb cover 12 is provided with a nut 25. The screw 22 is threaded to the nut 25 and penetrates through the bottom of the comb cover 12. A rotary cap 26 is connected to one end, penetrating through the bottom of the comb cover 12, of the screw 22.

The bottom of the accommodating chamber is provided with a dumping port 27.

It is worth noting that the button 21 or the rotary cap 26 may be mounted on the bottom of the comb cover 12 in an embedded manner, thus the protruding part is reduced, and the comb is more visually pleasant.

Figure 8:
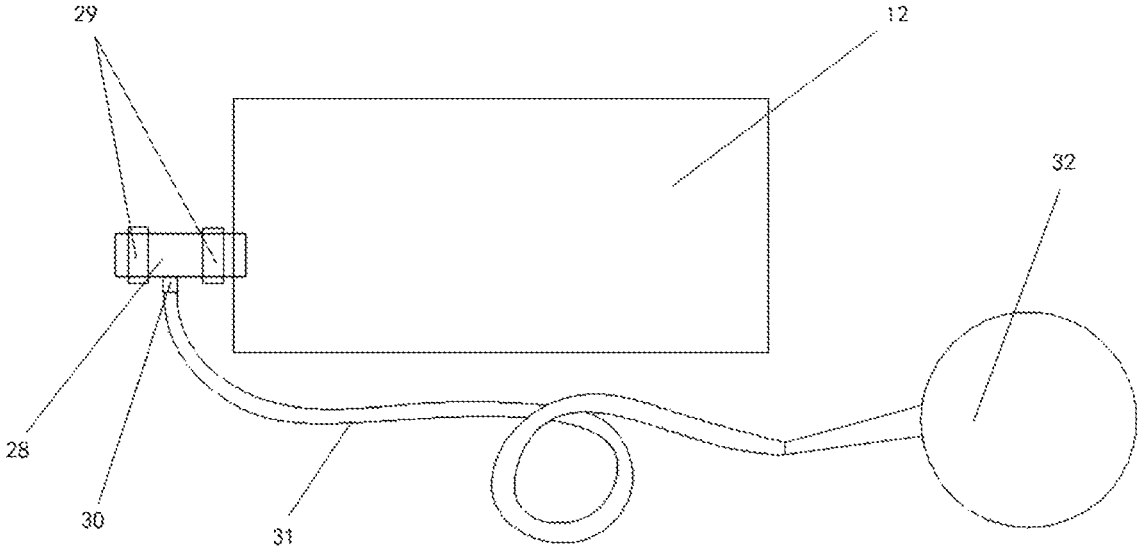
FIG. 8 is a diagram of a structure of a third comb cover.

As shown in FIG. 8, as a third embodiment of the comb cover 12 in the present disclosure, one side of the comb cover 12 is provided with a branch tube 28 communicating with the inside of the comb cover 12, two check valves 29 facing outwards are mounted on the branch tube (any of the check valves 29 only allows the gas in the comb cover 12 to be discharged to the outside of the comb cover 12, and the gas cannot enter the comb cover 12 in an opposite direction), the branch tube 28 between the two check valves 29 is provided with an adapter 30, and the adapter 30 communicates with a suction ball 32 by a hose 31.

In accordance with the embodiment, the ball 10 is pressed to compress the pressing plate 6, thus driving the ejector pins 7 to clean the dandruff, grease and the other impurities in the through holes of the comb teeth 5. Under the action of the first springs 8, the ball 10 may rebound. The ball 10 may also be used for daily playing. The cleaned impurities fall into the comb cover 12, and then the impurities in the comb cover 12 are further cleaned.

In the first embodiment of the comb cover 12, the first partition plate 13 is driven to open by the driving device; the cleaned impurities fall into the accommodating chamber formed by the first partition plate 13 and the comb cover 12, and then the impurities accumulated in the accommodating chamber are treated through the dumping port 27.

In the second embodiment of the comb cover 12, the limiting ball 16 is driven to open by the driving device; and the cleaned impurities fall into the internal accommodating chamber. The cleaned impurities fall into the accommodating chamber formed by the second partition plate 14 and the comb cover 12, and then the impurities accumulated in the accommodating chamber may be treated through the dumping port 27.

The driving device has two structures. The first structure is to compress the second spring 19 by using the pressing sheet 20, thus opening the first partition plate 13 or the limiting ball 16; and the device may reset automatically. The second structure is to open the first partition plate 13 or the limiting ball 16 in a manner of rotating by the screw 22, and the screw 22 needs to be manually rotated to reset.

In a third embodiment of the comb cover 12, through the combination of the suction ball 32 and the check valves 29, a closed space is formed inside after the comb cover 12 is closed. The suction ball 32 is configured to suck out the impurities from the check valve 29 at the right side, and then to discharge the impurities from the check valve 29 at the left side. Due to the adoption of the check valves, the impurities cannot return back to the comb cover 12.

Although the embodiments of the present disclosure have been described in detail above, it is apparent to those skilled in the art that various modifications and changes can be made to these embodiments. However, it should be understood that such modifications and changes are within the scope and spirit of the present disclosure in the claims. Moreover, the present disclosure described here may have other embodiments, and may be implemented or achieved in various ways.

What is claimed is:

1. A healthcare comb, comprising:

a comb handle; and a comb base, wherein a cavity is formed inside the comb base, the comb handle is mounted on one side of the comb base, a seat plate is arranged at a lower end of the comb base, and a top plate is arranged at a top end of the comb base;

wherein a plurality of comb teeth are arranged at one end, away from the top plate, of the seat plate, the plurality of comb teeth are provided with through holes along axial directions thereof, and openings corresponding to the through holes are formed in the seat plate;

wherein a pressing plate is arranged in the cavity of the comb base, ejector pins are arranged on the pressing plate and penetrate through the openings on the seat plate to extend into the through holes of the plurality of comb teeth;

wherein a first spring is mounted between the pressing plate and the seat plate, a first limiting hole is formed in an upper end of the top plate, and a ball is arranged between the first limiting hole and the pressing plate;

wherein the first spring is configured to limit the ball in the first limiting hole by being compressed between the pressing plate and the seat plate;

wherein a comb cover is mounted on a lower end of the seat plate, the comb cover comprising an opening;

wherein one end of the comb cover comprises an outer convex surface disposed opposite the opening, and a first partition plate seamlessly attached to an interior of the outer convex surface is arranged in the comb cover, such that an accommodating chamber is formed between the first partition plate and the outer convex surface;

wherein one end of the first partition plate, proximate the comb base, is a convex surface; and another end of the first partition plate distal to the comb base is a convex surface and comprises a driving device, wherein the driving device is configured to push the first partition plate to move towards the opening of the comb cover.

2. The healthcare comb according to claim 1, wherein the seat plate is clamped to the comb base, and the top plate and the comb base are of an integrated structure.

3. The healthcare comb according to claim 1, wherein the top plate is clamped to the comb base, and the seat plate and the comb base are of an integrated structure.

4. The healthcare comb according to claim 1, wherein the driving device comprises a push rod;

wherein the push rod is connected to the first partition plate;

wherein a mounting seat is arranged at a bottom of the comb cover, the push rod penetrates through the mounting seat and the bottom of the comb cover; a second spring sleeved outside the push rod is arranged in the mounting seat;

wherein a pressing sheet connected to the push rod is arranged between the second spring and the bottom of the comb cover; and wherein a button is mounted on one end, extending out of the bottom of the comb cover, of the push rod.

5. The healthcare comb according to claim 1, wherein the driving device comprises a screw on which a limiting groove is arranged; the first partition plate is sleeved with the limiting groove by a connector; wherein a bottom of the comb cover is provided with a nut; wherein the screw is threaded to the nut and penetrates through the bottom of the comb cover; and wherein a rotary cap is connected to one end, penetrating through the bottom of the comb cover, of the screw.

6. The healthcare comb according to claim 1, wherein a bottom of the accommodating chamber is provided with a dumping port.

* * * * *